United States Patent [19]

Lewis

[11] 4,364,564

[45] Dec. 21, 1982

[54] SHOCK ABSORBER FOR TENNIS PLAYERS

[76] Inventor: David Lewis, 29 Hudson Ave., Waldwick, N.J. 07463

[21] Appl. No.: 102,038

[22] Filed: Dec. 10, 1979

[51] Int. Cl.[3] ..... A63B 61/00

[52] U.S. Cl. ..... 273/29 R; 273/183 B

[58] Field of Search ..... 273/DIG. 19, DIG. 17, 273/29 R, 26 R, 26 C, 29 A, 35 R, 183 B, 186 R, 190 A, 54 R, 54 B, 54 BA, 189 R, DIG. 30, 73 C; 124/89

[56] References Cited

U.S. PATENT DOCUMENTS

| | | | |
|---|---|---|---|
| 3,269,729 | 8/1966 | Morrison | 273/189 R |
| 3,342,172 | 9/1967 | Sanders | 124/89 |
| 3,383,772 | 5/1968 | Gardner et al. | 273/54 BA |
| 3,490,766 | 1/1970 | Gardner | 273/DIG. 30 |
| 3,490,768 | 1/1970 | Archer | 273/26 C |
| 3,528,664 | 9/1970 | Gunn, Jr. | 273/183 B |

*Primary Examiner*—Richard C. Pinkham
*Assistant Examiner*—T. Brown
*Attorney, Agent, or Firm*—W. Patrick Quast

[57] ABSTRACT

There is disclosed a shock absorber for reducing the physiological effects on the arm and shoulder as normally experienced in tennis, racquetball or the like. The absorber includes a hollow housing in which is disposed a predetermined amount of liquid of predetermined density and means for securing the liquid filled housing to the player's arm. The preferred embodiment calls for liquid mercury disposed in the hollow portion of the housing, the mercury absorbing the vibrational effects resulting from the contacting of the ball with the racquet to thus reduce or eliminate the possible adverse effects on portions of the arm, such as the elbow or the shoulder.

8 Claims, 4 Drawing Figures

SHOCK ABSORBER FOR TENNIS PLAYERS

BACKGROUND OF THE INVENTION

FIELD OF THE INVENTION

This invention relates generally to a device for use in sporting events and, more particularly, to a device which eliminates or reduces elbow and shoulder pain resulting from physical use of the arm.

One of the most significant physical disabilities which inhibits a tennis player and, recently, racquetball players, has been tennis elbow. Once this condition sets in, pain at the elbow radiates down the forearm, which is further aggravated by stretching of the extensor muscles such as by flexing the wrist or fingers with the forearm pronated.

Symptoms eventually subside if the person is willing to give up all physical activity involving the arm. Of course, what tennis player is willing to do this!

Various devices have been developed which have been directed to relieving the pain associated with the condition. For example, a therapeutic tennis gauntlet which encases the forearm has been marketed. It is offered that the pain-causing vibration generated by the contact of the racquet with the ball is absorbed by the gauntlet before it gets to the elbow. Another device comprises a metal rod which is secured to the forearm by straps at the wrist and just below the elbow. Presumably, this dampens the vibration created by the contacted ball to thus minimize its effect at the elbow.

Other approaches include the development of tennis racquets which dampen the vibration at impact and filter them before they are transmitted to the arm through the grip. Typically, however, if the ball is hit off center, with such racquets the torque effect can still be felt in the arm.

Finally, of course, the player can submit to medicinal relief or heavy taping to isolate the pain.

Therefore, towards the end of providing an improved absorber for tennis players, racquetball players, and the like, there is disclosed an absorber which is compact and of simple construction such that it is relatively inexpensive but completely effective.

It is another object of this invention to provide an absorber which can be conveniently stored and used.

SUMMARY OF THE INVENTION

Towards the accomplishment of these and other objects which shall become apparent from the drawings and the following description, there is described a shock absorber for reducing adverse physiological effects on the arm or shoulder as experienced in tennis and racquetball. These effects are the result of the contacting of the ball or the like with an instrument held by the hand. The absorber comprises a hollow housing in which there is disposed a predetermined amount of liquid of predetermined density, preferably mercury. Means, such as a strap, are disclosed for securing the housing to the player's arm.

The liquid mercury is disposed in a portion of the hollow area of the housing. The inside surface of the hollow portion of the housing is contoured so as to direct any liquid displaced by vibration back into the common reservoir of the liquid.

The housing is molded from plastic either in a one piece construction or in a two piece construction. Typically, a non-brittle plastic is employed which eliminates the fracturing potential for the housing during normal intended use.

DESCRIPTION OF THE PREFERRED EMBODIMENT

Figure 1:
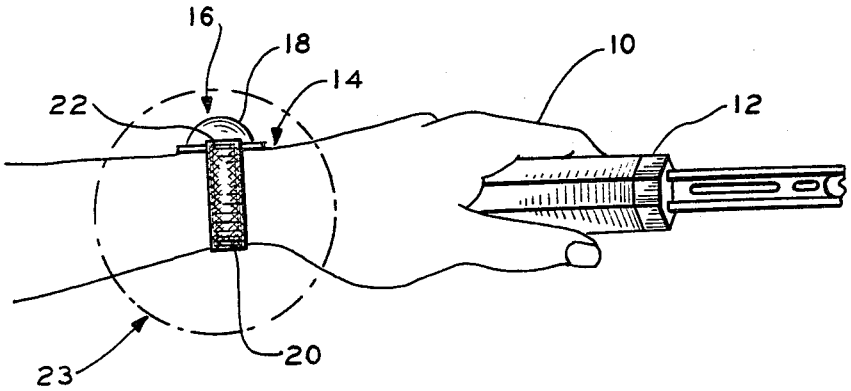
FIG. 1 is a perspective view showing the relative position of the present invention to a player's hand and racquet.

Referring now to FIG. 1, the hand, 10, of the tennis player, racquetball player or the like is shown gripping the handle, 12, of his racquet. Disposed about the player's wrist, 14, is the absorber, 16, of the present invention. It is seen to include a housing, 18, which is secured to the wrist by a strap, 20, which may be leather, plastic, valcro material, etc. The strap is connected to the housing, 18, at point 22 by any known means or technique.

Figure 2:
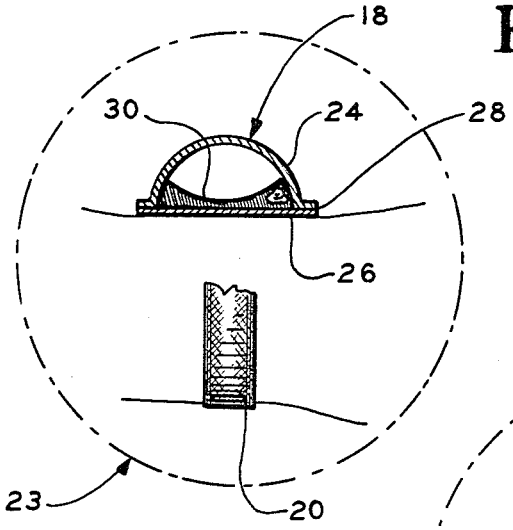
FIG. 2 is an enlargement of the portion of the players wrist where the present absorber of the present invention is located.

FIG. 2 is an enlargement of area 23 of FIG. 1 showing the housing portion in section so as to reveal the interior. The housing, 18, is hollow. It includes an upper portion, 24, which is bonded to complementing portion 26 at seam 28. An airtight enclosure is formed. Prior to sealing at seam 28, liquid mercury, 30, is placed in the hollow portion of the housing. Typical dimensions for an absorber that has been found effective in terms of adequate dampening of vibrations are a volume bounded by the inside surface of the portion 24, and the top surface of portion 26 which is typically 0.39 cubic inches. Into such a volume the applicant has disposed 1/24 of a liquid ounce of mercury which takes up approximately 0.13 cubic inches in the volume.

The housing portion, although depicted as two separate sections, can be constructed or molded in one piece from plastic, with an appropriate opening to allow partial filling of the volume with the desired amount of mercury and then sealed. The plastic selected should not be brittle. This is to avoid a fracturing of the material and spillage of the mercury. ABS, LEXAN, or the like, approximately 3/32 of an inch thick, has been found suitable.

The portion, 26, which rests upon the top surface of the wrist, can be contoured so as to fit comfortably upon the top side of the wrist.

Figure 3:
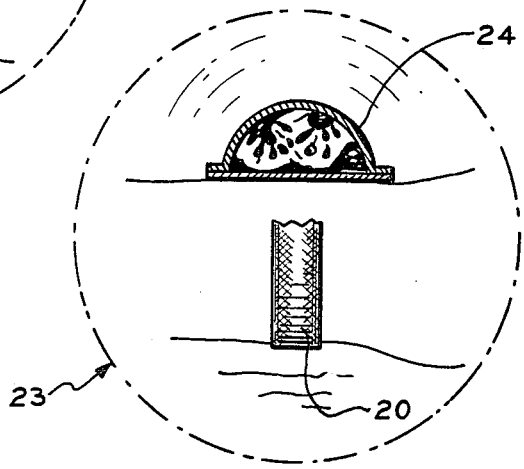
FIG. 3 is the same view as FIG. 2 showing the effect of vibration on the absorber of the present invention.

FIG. 3 demonstrates the effect of the vibration created by the ball hitting the racquet. The vibration is transmitted down the length of the racquet, 12, into the hand, 10, and would otherwise be transmitted up the forearm of the player except for the effect achieved by the present invention. The vibration results in a displacement of globules of the mercury from the reservoir thereof, the globules being thrust radially outward until they contact the inner surface of the upper portion of the housing, 24. The globules strike the inside surface and return to the reservoir of mercury disposed on the top surface of portion 26 of the housing.

The concentration of mercury at the player's wrist provides a dampening effect which reduces significantly the vibration transmitted along the forearm, and the attending aggravation which would otherwise be experienced by the elbow. The invention can also prevent the onset of tennis elbow or shoulder pain or both.

The absorber is also effective if positioned on the underside of the wrist.

Preferably, the interior of the top portion of the housing, 24, has a surface which is smooth and continuous without crevices or the like. This allows for recollecting of all of the dispersed liquid mercury into the reservoir, providing for a maximum absorbing effect. A spherically shaped portion, 24, would be suitable.

The plastic material can be clear or colored to enhance the marketability of the item.

Other variations and changes to the above-described embodiment may be effected without taking it beyond the scope of the present invention which is to be bounded only by the breadth of the claims set forth below.

What is claimed is:

1. A shock absorber for reducing the physiological effects on the arm or shoulder associated with the contact of a ball or the like with an instrument held by the hand, comprising:

(a) a hollow housing;

(b) approximately 0.13 cubic inches of liquid mercury disposed in the hollow portion of said housing, where the volume of said hollow portion is approximately 0.39 inches; and (c) means of securing the housing to the player's arm.

2. A shock absorber for reducing the physiological effects on the arm or shoulder associated with contact of a ball or the like with a playing racquet held by the hand comprising:

(a) a hollow housing;

(b) approximately 0.13 cubic inches of liquid mercury disposed in the hollow portion of said housing, where the volume of said hollow portion is approximately 0.39 inches and (c) means for securing the housing to the player's wrist.

3. The device claimed in either claim 1 or claim 2 wherein the means for holding the housing to the arm is a valcro strap.

4. The device claimed in either claim 1 or claim 2 wherein the inside surface of the hollow portion of said housing is contoured so as to direct any liquid displaced by vibration back into the common reservoir of such liquid.

5. The device claimed in either claim 1 or claim 2 wherein the hollow portion of said housing has a spherically-shaped, inside surface.

6. The device claimed in either claim 1 or claim 2 wherein the housing is molded from plastic.

7. The device claimed in either claim 1 or claim 2 wherein the housing is molded from plastic in one piece, said one piece, plastic housing after molding having an opening for filling thereof with said liquid, said opening capable of sealing after said liquid has been inserted.

8. The device claimed in either claim 1 or claim 2 wherein the housing is molded from non-brittle plastic such that it will not fracture when submitted to normal intended usage.

* * * * *